US008508564B2

(12) United States Patent
Mori et al.

(10) Patent No.: US 8,508,564 B2
(45) Date of Patent: Aug. 13, 2013

(54) THERMAL PRINT HEAD DEVICE AND THERMAL PRINTER

(75) Inventors: Yasuyuki Mori, Higashikurume (JP); Katsutoshi Mukaijima, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 113 days.

(21) Appl. No.: 13/307,411

(22) Filed: Nov. 30, 2011

(65) Prior Publication Data

US 2012/0133722 A1 May 31, 2012

(30) Foreign Application Priority Data

Nov. 30, 2010 (JP) ..... 2010-265933

(51) Int. Cl.
*B41J 25/304* (2006.01)

(52) U.S. Cl.
USPC ..... 347/197

(58) Field of Classification Search
USPC ..... 347/197, 198; 400/120.16, 120.17
See application file for complete search history.

(56) References Cited

U.S. PATENT DOCUMENTS

| | | | | |
|---|---|---|---|---|
| 8,194,108 | B1 * | 6/2012 | Long et al. | 347/197 |
| 8,405,697 | B2 * | 3/2013 | Tsuchiya et al. | 347/197 |
| 8,419,302 | B2 * | 4/2013 | Watanabe et al. | 347/197 |

FOREIGN PATENT DOCUMENTS

| | | |
|---|---|---|
| JP | 6-29849 | 4/1994 |
| JP | 7-246752 | 9/1995 |
| JP | 9-216393 | 8/1997 |

* cited by examiner

*Primary Examiner* — Kristal Feggins
(74) *Attorney, Agent, or Firm* — Wenderoth, Lind & Ponack, L.L.P.

(57) ABSTRACT

A thermal print head device includes a thermal print head placed to face a platen roller, a head holding member configured to hold the thermal print head, the head holding member extending in a tangential direction of the platen roller and being supported to be swingable about a portion away from the platen roller, a biasing member configured to bias the thermal print head or the head holding member, the biasing member having one end placed on a side of the thermal print head or the head holding member to press the thermal print head against the platen roller, and a point-of-action switching member disposed between the biasing member and the thermal print head or the head holding member biased by the biasing member.

7 Claims, 10 Drawing Sheets

THERMAL PRINT HEAD DEVICE AND THERMAL PRINTER

PRIORITY CLAIM

The present application is based on and claims priority from Japanese Patent Application No. 2010-265933, filed on Nov. 30, 2010, the disclosure of which is hereby incorporated by reference in its entirety.

BACKGROUND

1. Field of the Invention

The present invention relates to a thermal print head device and a thermal printer including the same, and specifically to the adjustment of pressing force between a thermal print head and a platen roller.

2. Description of the Related Art

In a thermal printer, information is thermally printed on thermal paper using a thermal print head. To achieve high-quality printing, it is important to appropriately bring the paper into close contact with a row of heating elements of the thermal print head. Accordingly, the thermal print head is biased to be pressed against a platen roller which also has the function of feeding the paper. A load (pressing force) by this biasing brings the thermal print head into close contact with the paper passing between the thermal print head and the platen roller.

In some cases, depending on paper to be used, it may be preferred to adjust a biasing force applied to the thermal print head. To satisfy such a demand, there have been proposed techniques (Japanese Patent Application Publication Nos. H7-246752 and H9-216393) to adjust the biasing force acting on the thermal print head using a cam and a technique (Japanese Utility Model Application Publication No. H6-029849) in which the position of a point of action at which the biasing force is exerted on a tiltable header support plate (member supporting the thermal print head) can be moved.

In the techniques (techniques described in Japanese Patent Application Publication Nos. H7-246752 and H9-216393) in which a cam is used to adjust the biasing force applied to the thermal print head, the pressing force applied to the thermal print head is changed according to the profile of the cam. Accordingly, not only a structure for holding the cam but also a mechanism for transferring a change in the profile of the cam to the thermal print head is needed. This results in a complex structure.

On the other hand, in the technique (technique described in Japanese Utility Model Application Publication No. H6-029849) in which the position of a point of action at which the biasing force is exerted on the thermal print head is changed, moment about a fulcrum for tilting is changed by changing the position of the point of action. Because of a configuration in which the whole of a pressing spring which exerts the biasing force is moved, there is the problem that a complex structure is needed to hold the whole of the pressing spring during, before, and after movement.

SUMMARY

The present invention has been made in view of the above-described circumstances. An object of the present invention is to provide a thermal print head device in which a pressing force applied to a thermal print head can be changed with a simple structure and a thermal printer including this thermal print head device.

A thermal print head device according to one embodiment of the present invention changes a pressing force applied to a thermal print head with a simple structure in which a point-of-action switching member disposed between the thermal print head and a biasing member applying the pressing force to the thermal print head moves one end of the biasing member.

Specifically, a thermal print head device according to one embodiment of the present invention includes a thermal print head placed to face a platen roller; a head holding member configured to hold the thermal print head, the head holding member extending in a tangential direction of the platen roller and being supported to be swingable about a portion away from the platen roller; a biasing member configured to bias the thermal print head or the head holding member, the biasing member having one end placed on a side of the thermal print head or the head holding member to press the thermal print head against the platen roller; and a point-of-action switching member disposed between the biasing member and the thermal print head or the head holding member biased by the biasing member, the point-of-action switching member moving in the tangential direction of the platen roller a point of action at which the one end of the biasing member comes into contact with the thermal print head or the head holding member.

Moreover, a thermal printer according to one embodiment of the present invention includes a main body and the thermal print head device according to one embodiment of the present invention in which the head holding member is supported by the main body to be swingable in an approximately radial direction of the platen roller.

BRIEF DESCRIPTION OF THE DRAWINGS

FIGS. 7A and 7B are views for explaining the relationship of points of action and elastic forces (biasing forces) to pressing forces, wherein FIG. 7A shows a first point of action for producing a relatively strong pressing force, and FIG. 7B shows a second point of action for producing a relatively weak pressing force.

DESCRIPTION OF THE PREFERRED EMBODIMENT

Hereinafter, specific embodiments of a thermal printer according to the present invention and a thermal print head device included in this thermal printer will be described with reference to the drawings.

Figure 1:
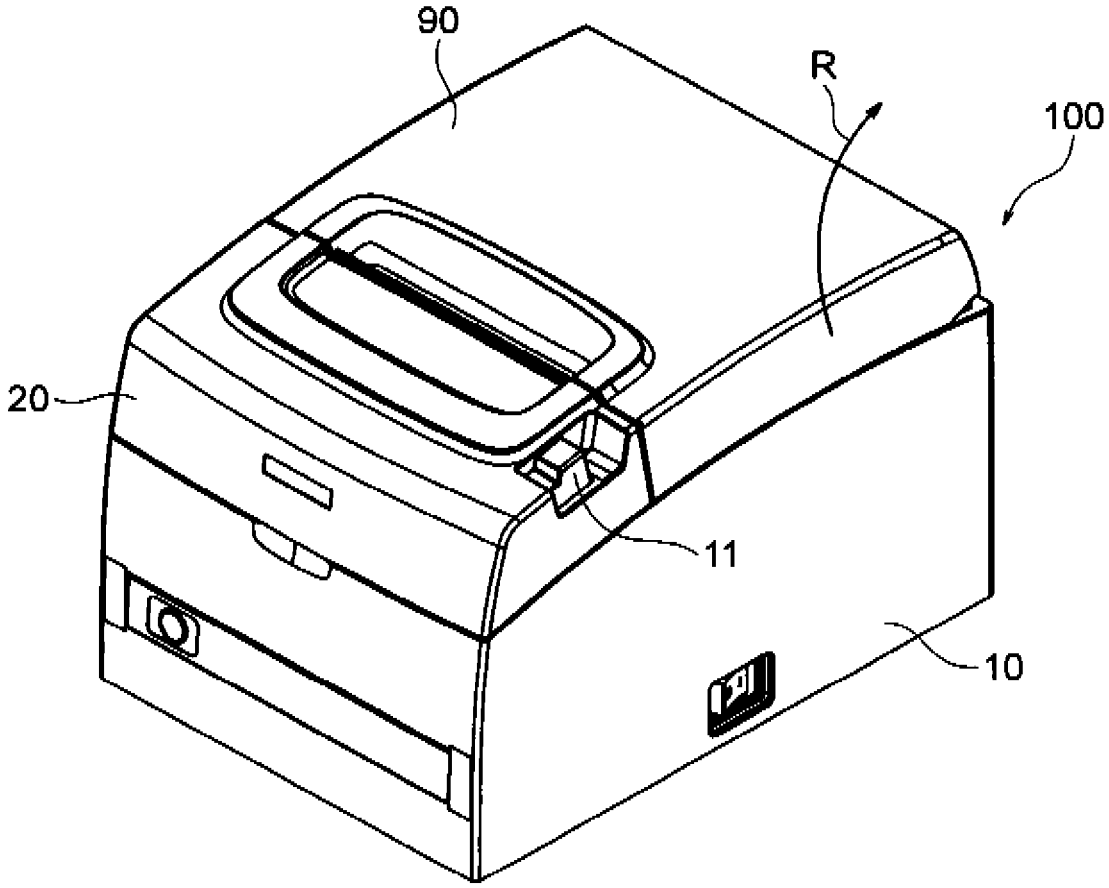
FIG. 1 is a perspective view showing a thermal printer as one embodiment of a thermal printer according the present invention.
Figure 2:
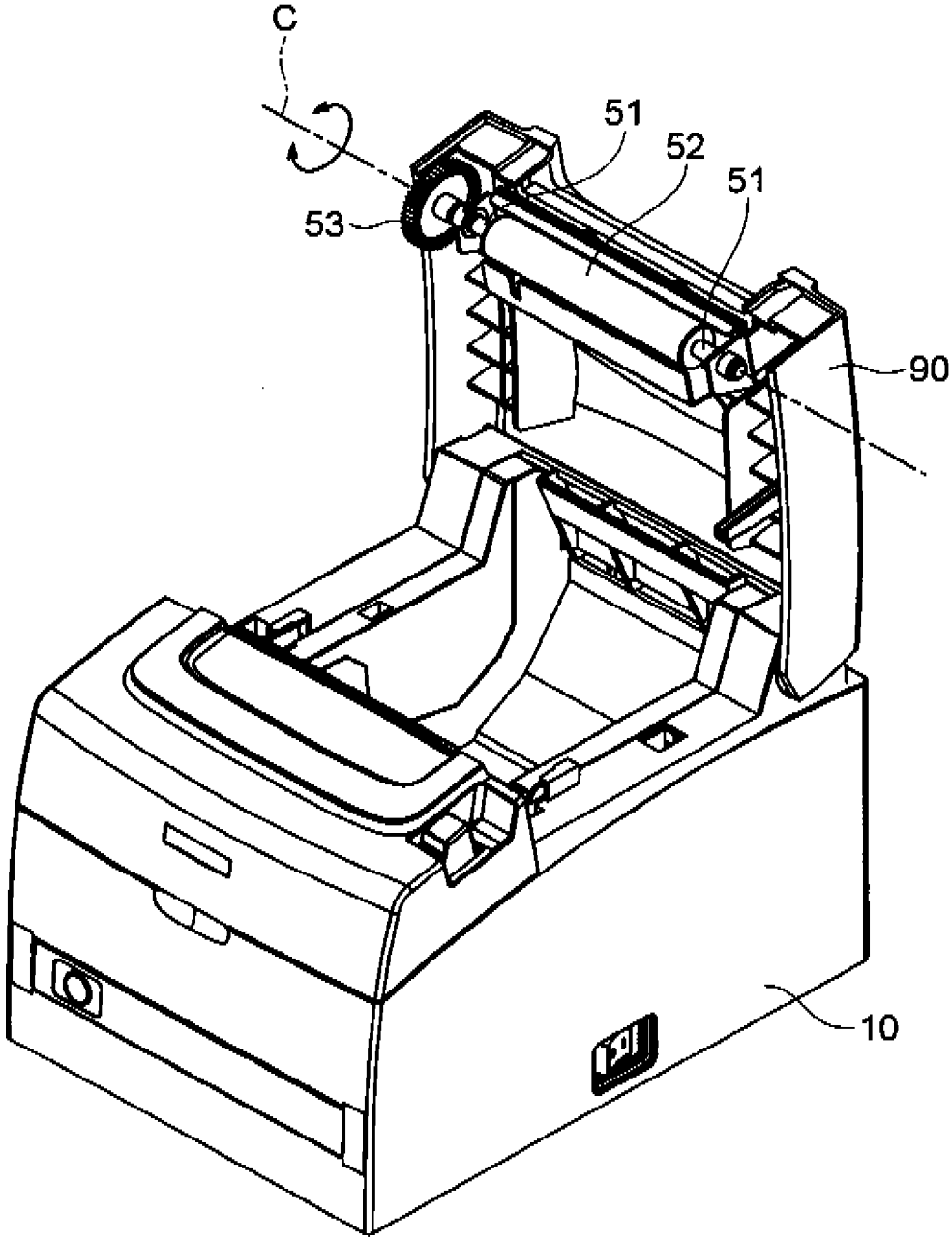
FIG. 2 is a perspective view showing the thermal printer shown in FIG. 1 with a cover thereof open.

FIG. 1 is a perspective view showing a thermal printer 100 as one embodiment of a thermal printer according to the present invention. By operating an open/close button 11 provided in a main body 10, a cover 90 is turned in the direction of arrow R to open, and the inside of the main body 10 is exposed as shown in FIG. 2. This allows easy access to portions such as a portion for housing paper.

Inside the cover 90 opened, a columnar shaft 51 is supported rotatably about the shaft center C thereof. Further, this shaft 51 has a cylindrical platen roller 52 and a disk-shaped platen gear 53 fixed thereto. The platen roller 52 extends in the direction of the shaft center C of the shaft 51. When the platen gear 53 is rotationally driven, the platen roller 52 also rotates through the shaft 51.

Figure 3:
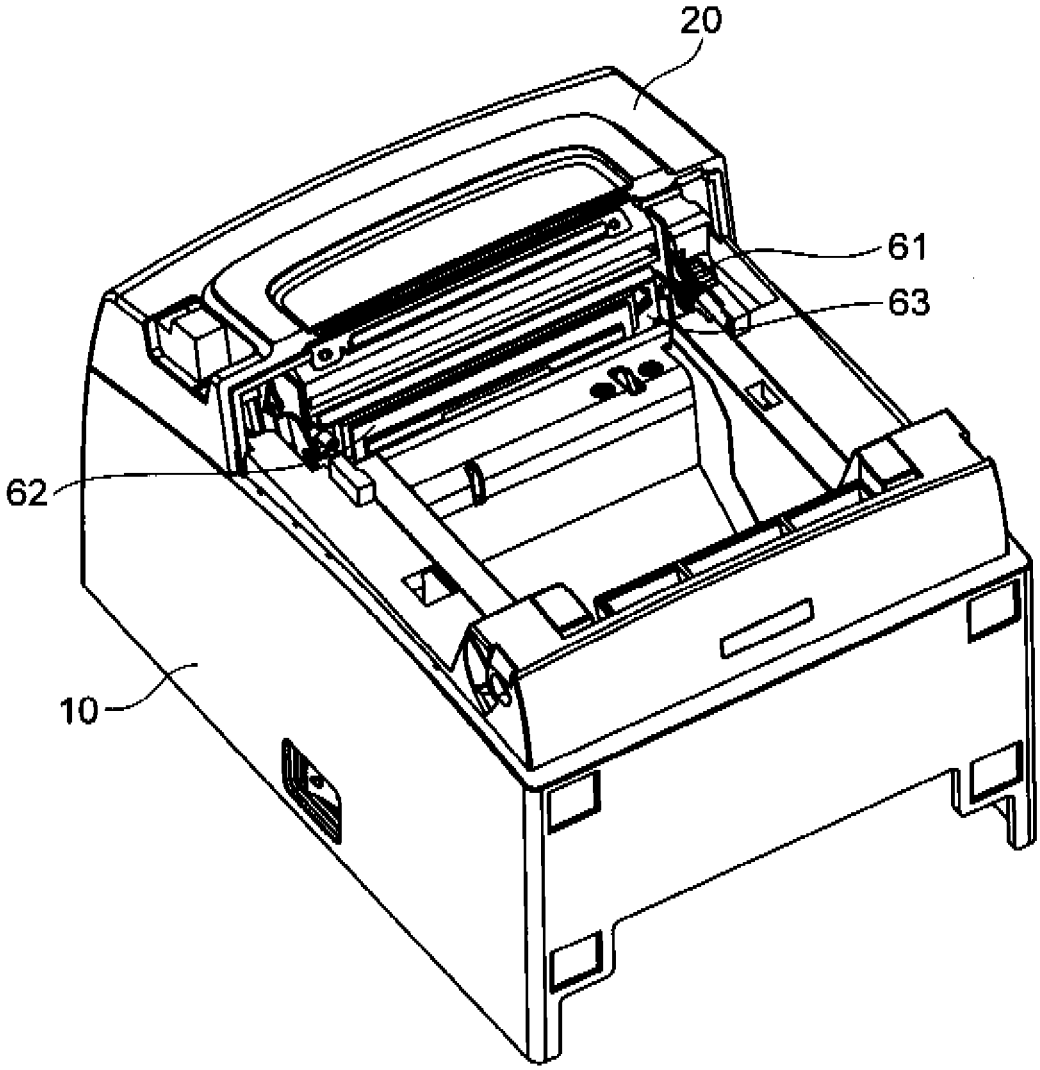
FIG. 3 is a perspective view of the thermal printer as seen from the backside with the cover removed in the state shown in FIG. 2.

On an upper surface of the main body 10, a detachable half-cover 20 is provided in addition to the cover 90. As shown in FIG. 3, which is a perspective view of the thermal printer 100 as seen from the backside and in which the cover 90 opened, the platen roller 52 disposed thereon, and the like in FIG. 2 are omitted, a thermal print head 62 for applying heat to thermal paper to thermally print desired letters, figures, and the like, a gear train 61 which meshes with the platen gear 53, and the like are disposed inside the half-cover 20.

In a state in which the cover 90 is closed as in FIG. 1, the gear train 61 and the platen gear 53 come into mesh with each other, and the driving force of an unillustrated drive source (motor or the like) is transmitted to the platen gear 53. Thus, the platen gear 53 rotates, and the platen roller 52 rotates through the shaft 51.

Moreover, in a state in which the cover 90 is closed as described above, the platen roller 52 and the thermal print head 62 are in contact with each other while facing each other. Desired letters and the like can be thermally printed on the thermal paper in the following manner: the thermal paper is passed through a gap between the platen roller 52 and the thermal print head 62; while the thermal paper is being fed by rotating the platen roller 52, an electric current is passed through the thermal print head 62 to cause the thermal print head 62 to generate heat.

The thermal print head 62 is held by a head holding plate 63 (head holding member) having a backside thereof made of sheet metal.

Figure 4:
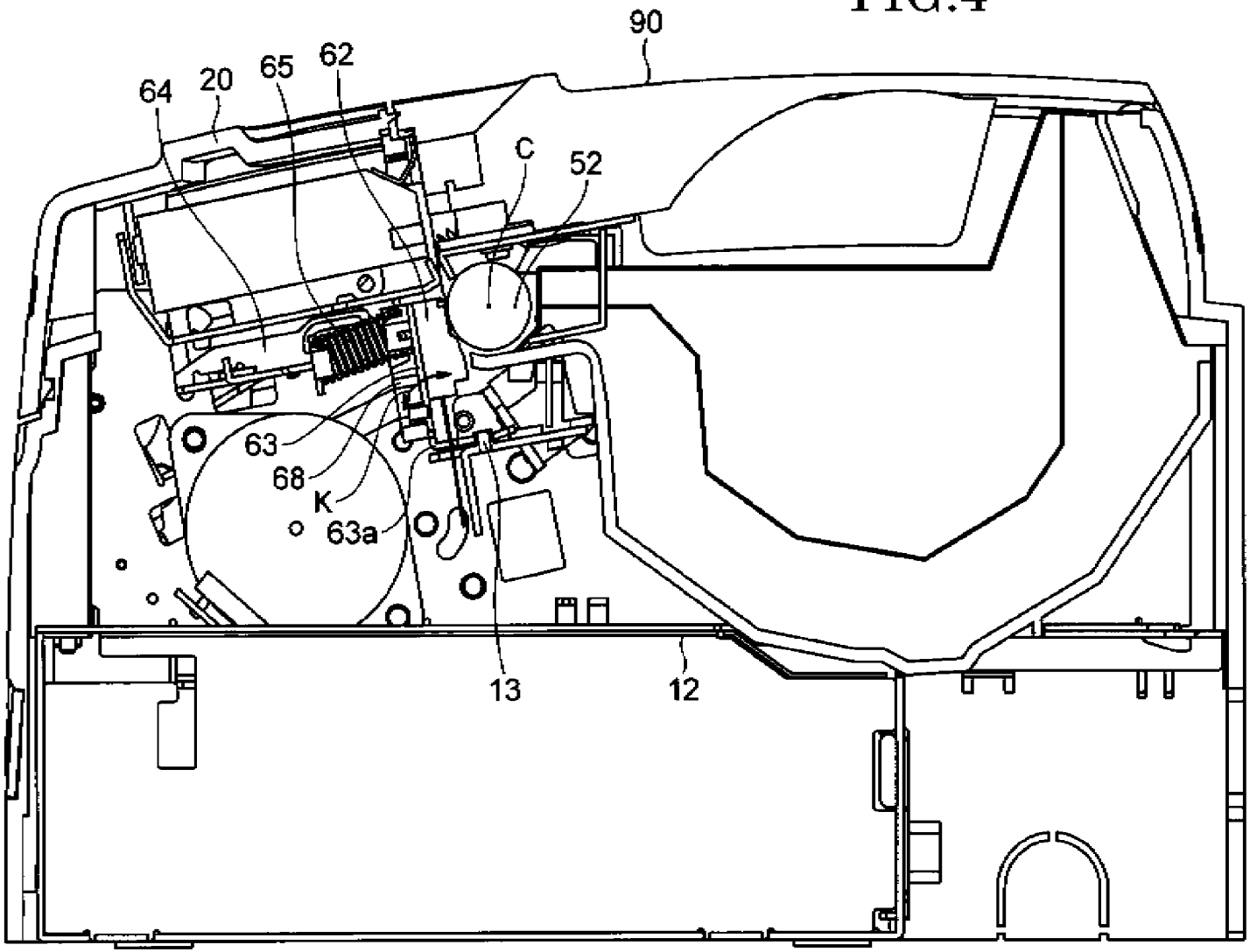
FIG. 4 is a cross-sectional view showing the positional relationship among a platen roller, a thermal print head, a head holding plate, coil springs, and a point-of-action switching plate.

As shown in the cross-sectional view of FIG. 4, this head holding plate 63 has a cut-away portion 63*a* provided in a lower end portion thereof. The cut-away portion 63*a* has a shaft portion 13 inserted therethrough. The shaft portion 13 (formed by, for example, hole flanging, and disposed near a position corresponding to an approximately longitudinal center of the platen roller 52 or the thermal print head 62) is formed to extend approximately upward from a member fixed to a sheet metal frame 12, which forms the skeleton of the main body 10. The head holding plate 63 is indirectly supported by the main body 10 to be swingable in the direction of arrow K (toward and away from the platen roller 52) about the shaft portion 13, as a center (fulcrum), which is inserted through the cut-away portion 63*a* formed at a position away from the platen roller 52.

It should be noted that the thermal print head 62 is disposed to face the circumferential surface of the platen roller 52 in contact therewith and that the head holding plate 63 extends in a tangential direction of the platen roller 52.

Moreover, on the backside (opposite surface from the surface on which the thermal print head 62 is held) of the head holding plate 63, coil springs 65 (biasing member, elastic members) are disposed which press the thermal print head 62 against the platen roller 52.

Figure 5:
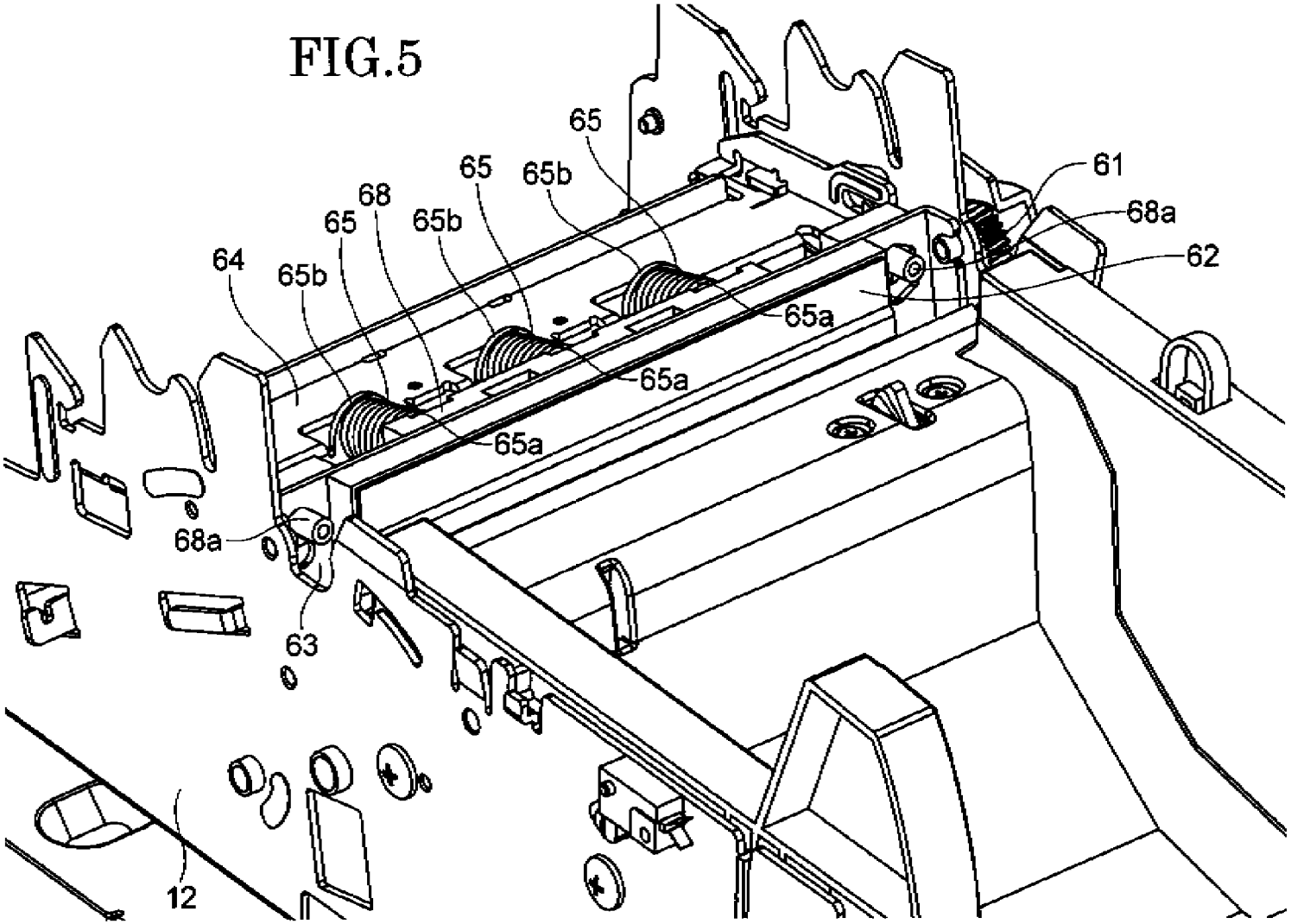
FIG. 5 is a perspective view of a principal part for explaining the arrangement of the coil springs and the placement of the point-of-action switching plate.

As shown in FIG. 5, the number of coil springs 65 is three, and the coil springs 65 are arranged at approximately equal intervals in the axial direction (direction in which the thermal print head 62 extends, longitudinal direction) of the platen roller 52.

Further, one end 65*a* of each of the three coil springs 65, 65, 65 is located on the head holding plate 63 side (the thermal print head 62 side), and an inner circumferential portion of other end 65*b* thereof is fixed to a protruding portion formed in a spring holding member 64 (biasing member, elastic-member holding member) fixedly supported by the sheet metal frame 12 of the main body 10.

Moreover, as shown in FIG. 5, a point-of-action switching plate 68 (point-of-action switching member) is provided between the one ends 65*a*, 65*a*, 65*a* of the three coil springs 65, 65, 65 located on the thermal print head 62 side and the head holding plate 63. The point-of-action switching plate 68 is made of resin and movable in the tangential direction (direction in which the head holding plate 63 extends) of the platen roller 52.

Figure 6:
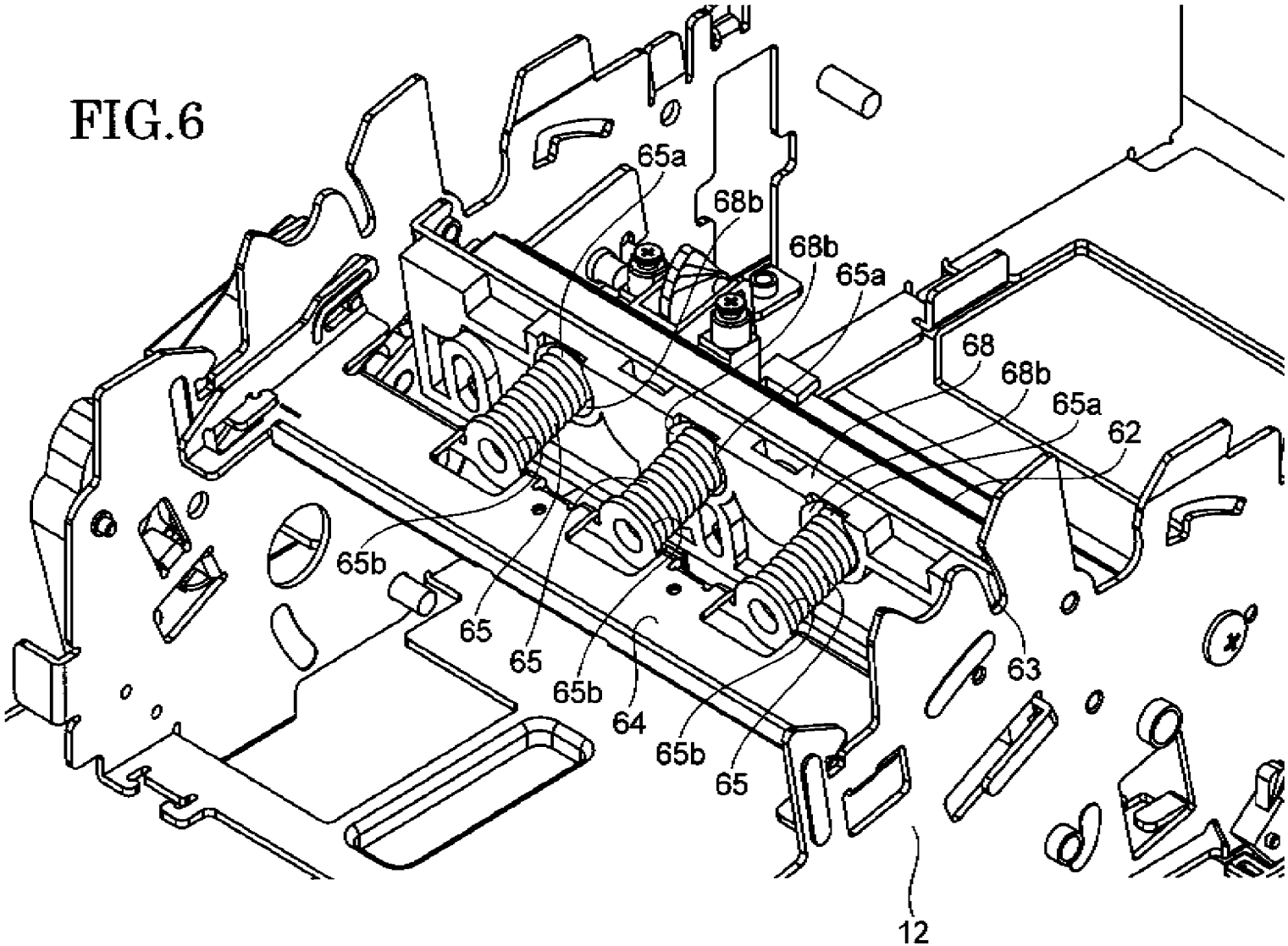
FIG. 6 is a perspective view of the coil springs and the like as seen from the backside of FIG. 5.

As shown in FIG. 6, this point-of-action switching plate 68 has three protrusion-and-recess portions 68*b* (elastic-member holding structure) for holding the one ends 65*a* of the coil springs 65 individually. The protrusion-and-recess portions 68*b* are formed to be arranged in a row in the axial direction of the platen roller 52. The one ends 65*a*, 65*a*, 65*a* of the three coil springs 65, 65, 65 are held by the corresponding protrusion-and-recess portions 68*b*, 68*b*, 68*b*, respectively.

Accordingly, when the point-of-action switching plate 68 moves in the tangential direction of the platen roller 52, the one ends 65*a*, 65*a*, 65*a* of the three coil springs 65, 65, 65 can be integrally moved for the same distance.

Figure 7B:
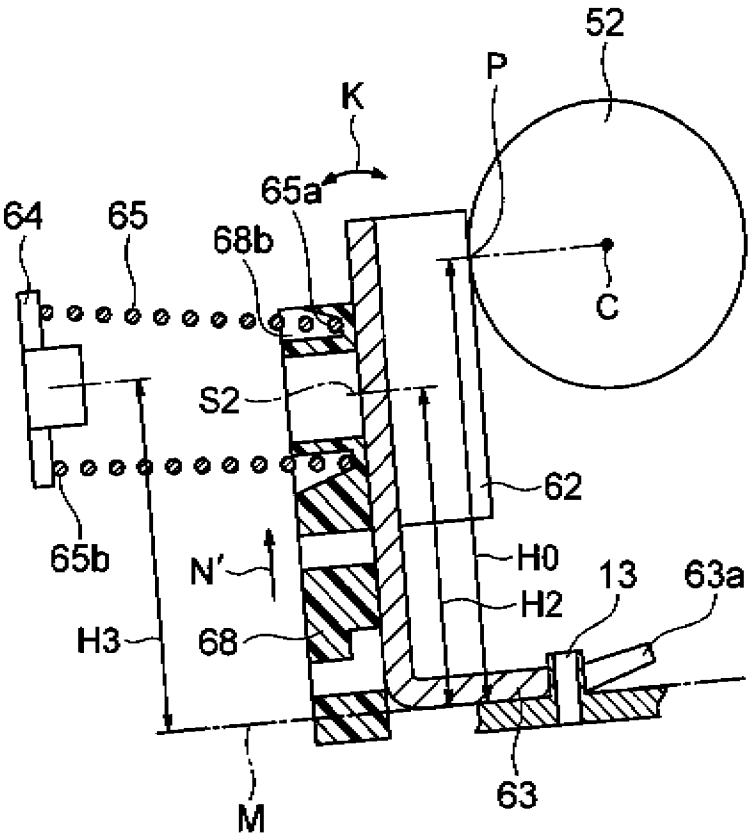
Figure 7A:
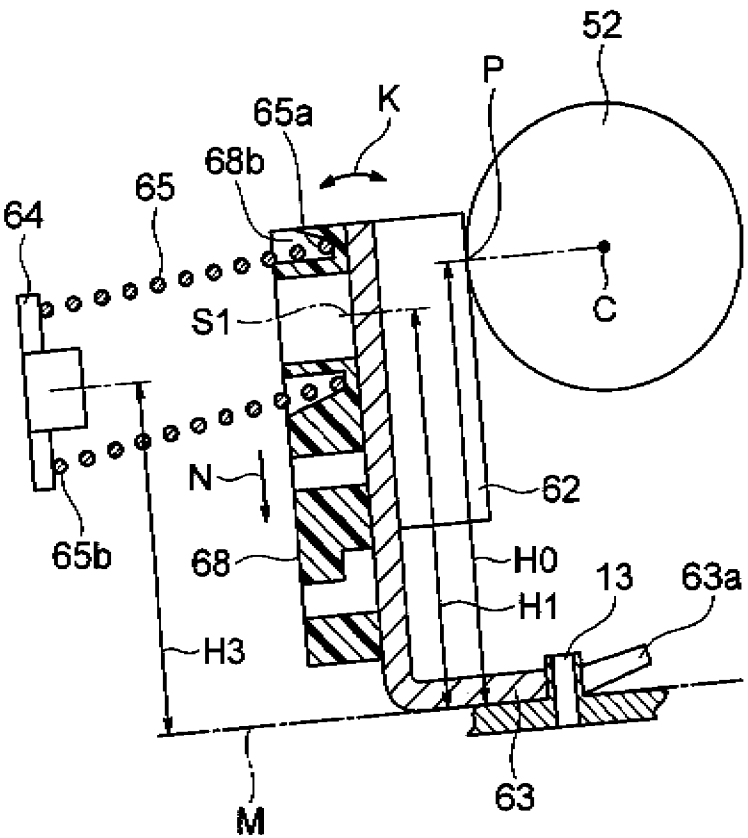

It should be noted that each protrusion-and-recess portion 68*b* includes a recessed portion having the shape of an annular groove and a protruding portion surrounded by the annular groove, and that as shown in the cross-sectional views of FIGS. 7A and 7B, the protruding portion protrudes in an inner space surrounded by a wire of the coil spring 65 with a wire portion of the one end 65*a* of the coil spring 65 fitted in the recessed portion.

In FIGS. 7A, 7B, and the like, though the one end 65*a* of the coil spring 65 looks to be loosely fitted to the protrusion-and-recess portion 68*b* of the point-of-action switching plate 68, the fit therebetween is not limited to a loose one. Dimensions and shapes of the coil spring 65 and the point-of-action switching plate 68 may be set to tighten the fit therebetween. Tightening the fit therebetween in such a manner makes it possible to deal with the coil springs 65 and the point-of-action switching plate 68 as a unit in which the coil springs 65 and the point-of-action switching plate 68 are integrated, and can improve the assembling workability of the thermal printer 100.

Figure 8:
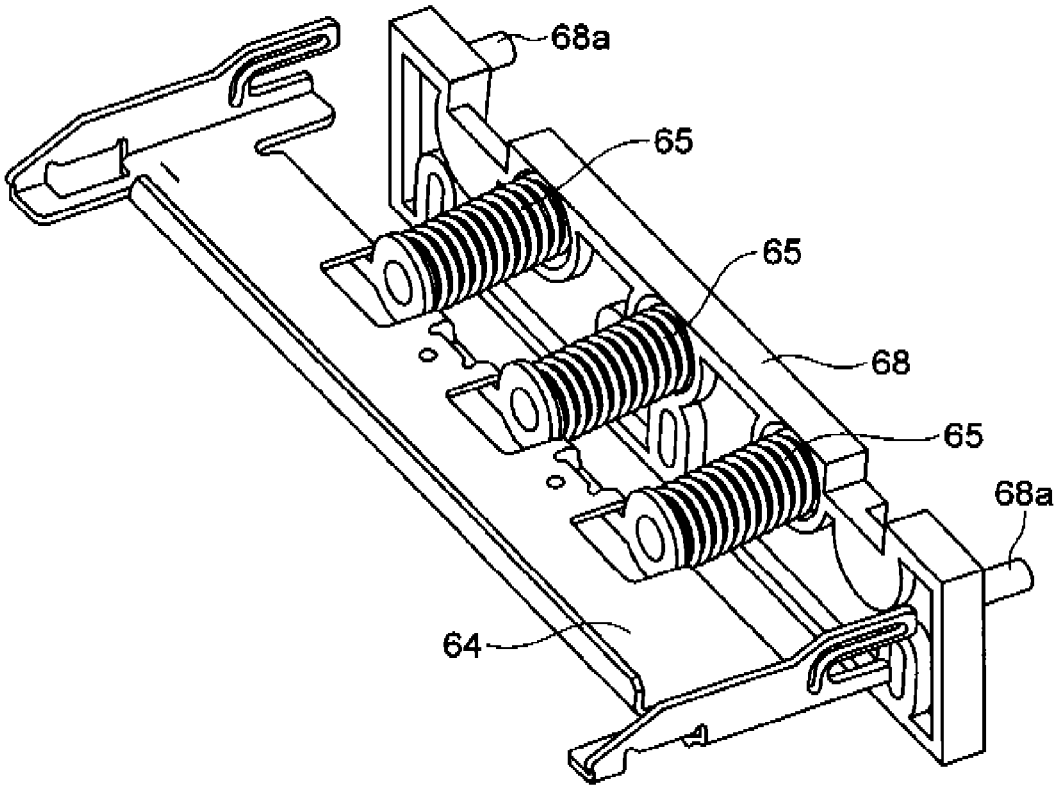
FIG. 8 is a perspective view showing a configuration in which the coil springs, the spring holding member, and the point-of-action switching plate are integrated.

It should be noted that since the coil springs 65 and the spring holding member 64 are also integrated, the point-of-action switching plate 68, the three coil springs 65, and the spring holding member 64 can be dealt with an integrated structure such as shown in FIG. 8. This can reduce the numbers of jigs and steps for assembly, and can further improve the assembling workability.

Figure 9:
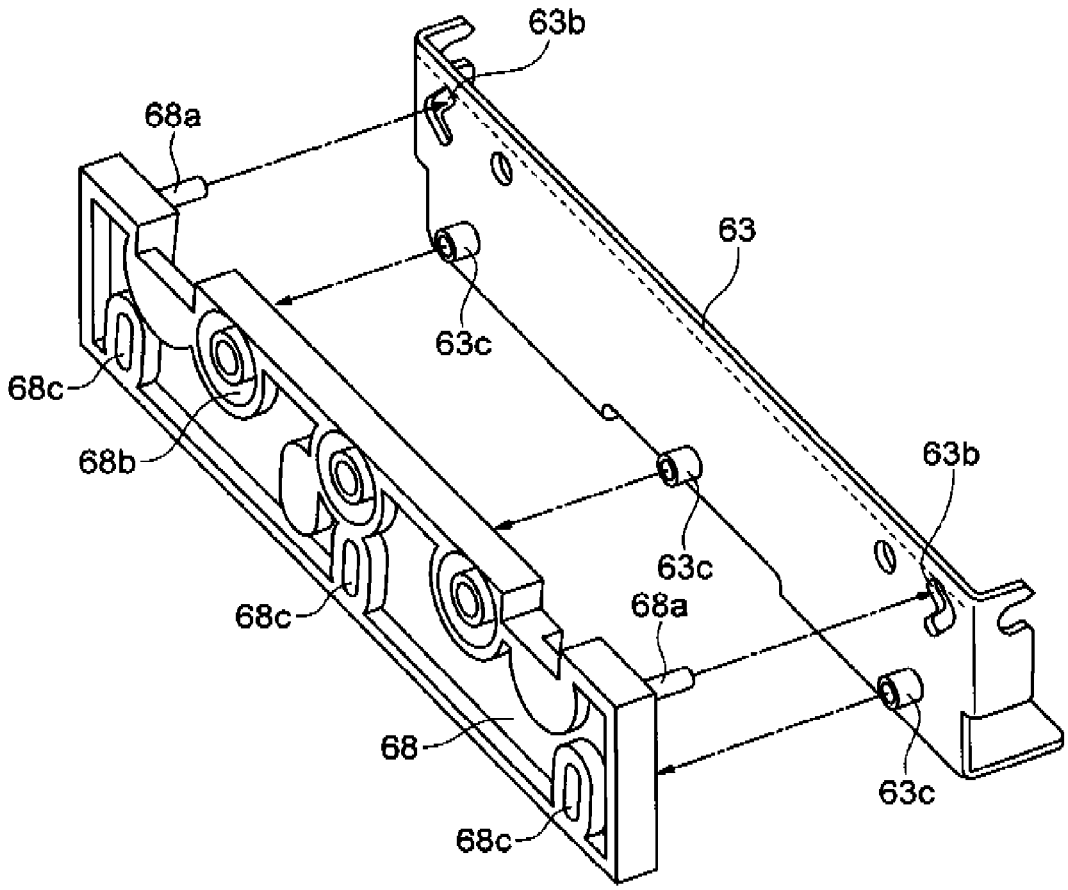
FIG. 9 is a perspective view for explaining a structure for moving the point-of-action switching plate along the back of the head holding plate.

The point-of-action switching plate 68 can move in the tangential direction of the platen roller 52 by moving along the back of the head holding plate 63. A structure for realizing this movement will be described with reference to FIGS. 9, 10A, and 10B.

Specifically, the point-of-action switching plate 68 has nails 68*a* (operating portions) formed near two longitudinal ends of the point-of-action switching plate 68, respectively. The nails 68*a* protrude toward the head holding plate 63 from a surface of the point-of-action switching plate 68 which faces the head holding plate 63. On the other hand, the head holding plate 63 has approximately L-shaped or approximately inverted L-shaped through-holes 63*b*, 63*b* formed in portions corresponding to these nails 68*a*, 68*a* in the longitudinal direction thereof. The nails 68*a*, 68*a* pass through the through-holes 63*b*, 63*b*, respectively.

Moreover, the point-of-action switching plate 68 has three long openings 68*c* formed near a lower portion thereof in the drawing. The long openings 68*c* extend in the vertical direction of the drawing. On the other hand, the head holding plate 63 has cylindrical protrusions 63*c*, 63*c*, 63*c* in portions corresponding to these long openings 68*c*, 68*c*, 68*c* in the longitudinal direction thereof, respectively. The protrusions 63*c*, 63*c*, 63*c* protrude toward the point-of-action switching plate 68.

Further, the nails 68*a* of the point-of-action switching plate 68 are respectively inserted into the through-holes 63*b*, 63*b* of the head holding plate 63, and the protrusions 63*c* of the head holding plate 63 are respectively inserted into the long openings 68*c*, 68*c*, 68*c* of the point-of-action switching plate 68. Since the protrusions 63*c* of the head holding plate 63 can move in the vertical direction of the drawing in the ranges of the long openings 68*c*, 68*c*, 68*c* of the point-of-action switching plate 68, the point-of-action switching plate 68 can move in the tangential direction of the platen roller 52.

Figure 10A:
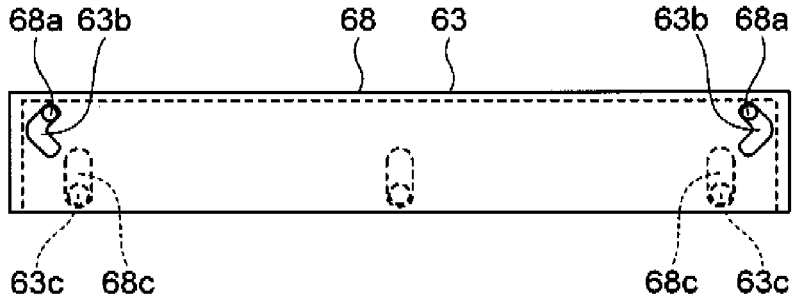
FIGS. 10A and 10B are views for explaining a structure for realizing the switching of the points of action by moving the point-of-action switching plate along the back of the head holding plate, and show states corresponding to the first and second points of action, respectively.

As shown in FIG. 10A, when the protrusions 63*c* of the head holding plate 63 are located in lower portions of the long openings 68*c*, 68*c*, 68*c* of the point-of-action switching plate 68 in the drawing, the nails 68*a* of the point-of-action switching plate 68 are located in upper end portions of the through-holes 63*b*, 63*b* of the head holding plate 63 in the drawing. Thus, the point-of-action switching plate 68 is located at a relatively high position with respect to the head holding plate 63.

Figure 10B:
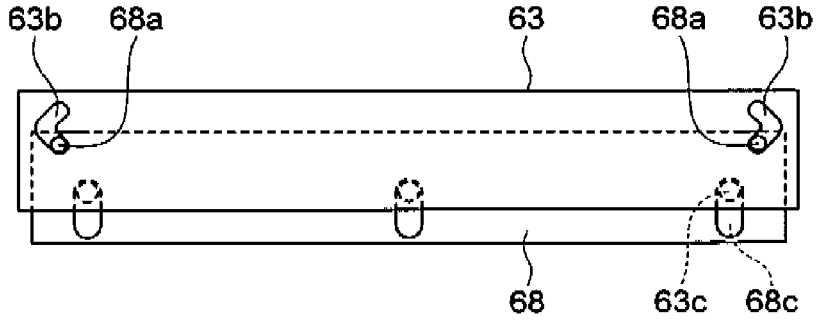

On the other hand, as shown in FIG. 10B, when the protrusions 63*c* of the head holding plate 63 are located in upper portions of the long openings 68*c*, 68*c*, 68*c* of the point-o£-action switching plate 68 in the drawing, the nails 68*a* of the point-of-action switching plate 68 are located in lower end portions of the through-holes 63*b*, 63*b* of the head holding plate 63 in the drawing. Thus, the point-of-action switching plate 68 is located at a relatively low position with respect to the head holding plate 63.

It should be noted that the distance between the two nails 68*a*, 68*a* of the point-of-action switching plate 68 is set to be approximately equal to the distance between upper or lower end portions of the two through-holes 63*b*, 63*b* of the head holding plate 63 in the drawing. Accordingly, when the two nails 68*a*, 68*a* of the point-of-action switching plate 68 are moved, for example, from the state (state of being located in upper end portions of the through-holes 63*b*, 63*b* in the drawing) shown in FIG. 10A to the state (state of being located in lower end portions of the through-holes 63*b*, 63*b* in the drawing) shown in FIG. 10B, or when the two nails 68*a*, 68*a* of the point-of-action switching plate 68 are moved oppositely, the nails 68*a*, 68*a* need to be passed through approximately central portions (approximately central portions of the trough-holes 63*b* in the vertical direction) which are separated by a distance larger than the distance between the upper end portions and the distance between the lower end portions. The nails 68*a* can be passed through these approximately central portions of the through-holes 63*b* by deflecting the nails 68*a* outward by the elasticity thereof.

As described above, the two nails 68*a*, 68*a* of the point-of-action switching plate 68 are in a stable state (state in which the nails 68*a* have no or small deflections) when located in upper or lower end portions of the through-holes 63*b* of the head holding plate 63, and therefore can be said to selectively take one of two positions, which are, for example, a lower end position (first position) and an upper end position (second position).

It should be noted that the conditions shown in FIGS. 10A and 10B are conditions capable of being visually identified by a user in the state shown in FIG. 3 in which the cover 90 is open. Accordingly, in the thermal printer 100 of this embodiment, when the user performs the operation of moving the nails 68*a*, 68*a* of the point-of-action switching plate 68 from the above-described first position to the above-described second position or from the second position to the first position, the nails 68*a*, 68*a* can be exposed as shown in FIGS. 10A and 10B only by opening the cover 90. Thus, the nails 68*a*, 68*a* exposed can be easily accessed by an operation such as imposing a load on the nails 68*a*, 68*a* with the tip of a precision screwdriver, the tip of a writing material, or the like, and the nails 68*a*, 68*a* can be easily moved.

Next, referring to FIGS. 7A and 7B, a pressing force F applied to the platen roller 52 by the thermal print head 62 will be described for the case (state shown in FIG. 10A) where the point-of-action switching plate 68 is located at the first position (position taken when the nails 68*a*, 68*a* are located at the upper end portions of the through-holes 63*b*) and the case (state shown in FIG. 10B) where the point-of-action switching plate 68 is located at the second position (position taken when the nails 68*a*, 68*a* are located at the lower end portions of the through-holes 63*b*).

The pressing force F applied to the platen roller 52 by the thermal print head 62 depends on a biasing force f acting on the back of the thermal print head 62 by the coil springs 65, and depends on a rotation moment produced by the biasing force f, because the thermal print head 62 is held by the head holding plate 63 and the head holding plate 63 swings about the position of the shaft portion 13 by which the head holding plate 63 is supported.

Specifically, the pressing force F at a contact point P (portion of the thermal print head 62 in which heating elements are formed) of the thermal print head 62 and the platen roller 52 changes according to a distance H from a reference plane M about which the head holding plate 63 swings to a point of action S on which the coil spring 65 acts.

Specifically, when the nail 68*a* of the point-of-action switching plate 68 is located at the first position (state shown in FIG. 7A), the distance from the reference plane M to a first point of action S1 (center of the one end 65*a* of the coil spring 65) at which the coil spring 65 acts is denoted by H1, and an elastic force of the coil spring 65 which acts on the first point of action S1 is denoted by f1. Then, the pressing force F1 by the elastic force f1 at the contact point P of the thermal print head 62 located at a distance H0 (H1<H0) from the reference plane M and the platen roller 52 is obtained from the equilibrium of moments as the following equation (1):

$$F1=f1\times H1/H0 \quad (1)$$

On the other hand, when the nail 68*a* of the point-of-action switching plate 68 is located at the second position (state shown in FIG. 7B), the distance from the reference plane M to a second point of action S2 (center of the one end 65*a* of the coil spring 65) at which the coil spring 65 acts is denoted by H2 (H2<H0), and an elastic force of the coil spring 65 which acts on the second point of action S2 is denoted by f2. Then, the pressing force F by the elastic force 12 at the contact point P of the thermal print head 62 located at a distance H0 from the reference plane M and the platen roller 52 is obtained from the equilibrium of moments as the following equation (2):

$$F2=f2\times H2/H0 \quad (2)$$

Here, in the case where the first point of action S1 and the second point of action S2 are set such that the amount of deflection (compression distance) of the coil spring 65 at the first point of action S1 and that at the second point of action S2 are equal, the elastic force f1 of the coil spring 65 at the first point of action S1 and the elastic force M of the coil spring 65 at the second point of action S2 are equal.

$$f1=f2 \quad (3)$$

In this case, the relationship between the pressing force F1 and the pressing force F2 becomes, from the equations (1), (2), and (3), $$F1/F2=H1/H2 \quad (4)$$

The relationship between the distance H1 and the distance H2 is $$H2<H1 \quad (5)$$

Accordingly, we obtain $$F2<F1 \quad (6)$$

Accordingly, by moving the point-of-action switching plate 68 in the tangential direction of the platen roller 52 (direction of arrow N or arrow N') the magnitude of the pressing force F applied to the thermal print head 62 can be changed.

As described above, in the thermal printer 100 of this embodiment, the thermal print head 62, the head holding plate 63, the coil spring 65 and the spring holding member 64, and the point-of-action switching plate 68 constitute one example of the thermal print head device according to the present invention. This thermal print head device makes it possible to change the pressing force F applied to the thermal print head 62 with a simpler structure than a device in which a cam is used.

Also, the coil spring 65 for producing the elastic force f, which is the biasing force that makes the thermal print head 62 biased, is configured such that only the one end 65*a* of the coil spring 65 is moved by the point-of-action switching plate 68 provided between the coil spring 65 and the head holding plate 63. Accordingly, unlike a configuration in which the whole of the coil spring 65 is moved, a structure for holding the whole of the coil spring 65 during movement is unnecessary. Thus, a simple structure can be employed.

In this embodiment, the other end 65*b* of the coil spring 65 is held by the spring holding member 64, and this spring holding member 64 is fixedly supported by the sheet metal frame 12 of the main body 10. Accordingly, in the coil spring 65, the one end 65*a* held by the protrusion-and-recess portion 68*b* of the point-of-action switching plate 68 swings about the other end 65*b* held by the spring holding member 64. Thus, the point of action of the elastic force f is changed.

Moreover, in the thermal print head device of this embodiment, the elastic force f is exerted on the thermal print head 62 by the three identical coil springs 65, 65, 65 arranged in the axial direction of the platen roller 52. Accordingly, the uniformity of elastic forces f acting on positions in the axial direction of the platen roller 52 can be improved compared to the case where an elastic force is exerted only by a single coil spring 65.

Also, since these three coil springs 65, 65, 65 can be integrally moved for the same distance by the single point-of-action switching plate 68, labor can be saved compared to the labor of individually moving the coil springs 65 one by one.

It should be noted that the number of coil springs 65 arranged in the axial direction of the platen roller 52 is not limited to three, and may be two, or four or more. Of course, though a device including only one coil spring 65 may be an embodiment of the thermal print head device of the present invention, from the viewpoint of the aforementioned uniformity of the pressing force, a device including two or more coil springs 65 is superior.

In the thermal print head device of this embodiment, with regard to the point (point of action) on which the elastic force f by the coil spring 65 acts, any one of two points (points of action S1, S2) can be selected. However, in the thermal printer and the thermal print head device according to the present invention, the number of selectable points of action is not limited to two. Three or more points of action S1, S2, . . . may be set so that any one thereof can be selected.

Moreover, instead of locating a plurality of selectable points of action S at discrete positions such as described above, any continuous positions may be selectable. In this case, the through-hole 63*b* of the aforementioned head holding plate 63 may be a through-hole simply extending in the vertical direction in the shape of a straight line, not an approximately L-shaped or approximately inverted L-shaped through-hole, such as shown in FIGS. 10A and 10B, which has end portions that stably hold the nail 68*a*.

In the thermal print head device of this embodiment, the amounts of deflection of the coil spring 65 at the two selectable points of action S1, S2 are set to be equal, and the elastic forces f1, f2 produced by the deflections are set to be equal. In a thermal print head device in which the elastic forces f1, f2 at two points of action S1, S2 are set to be equal to each other in this way, the pressing force F applied to the thermal print head 62 can be changed depending only on the distance H from a reference plane to a point of action S. Accordingly, when the strong/weak ratio (F1/F2) of the pressing force F1 exerted when the elastic force f acts on the point of action S1 to the pressing force F2 exerted when the elastic force f acts on the point of action S2 is set, the strong/weak ratio can be set based only on the ratio (H1/H2) between the distances H1, H2 to the points of action S1, S2. Thus, convenience in design can be improved.

It should be noted that the thermal print head device of the present invention is not limited to this configuration. As can be seen from the aforementioned equation (1) or (2), the distance H0 is constant irrespective of the position of the point of action. Accordingly, the pressing force F applied to the thermal print head 62, which is produced by the elastic force f acting on the point of action (distance H), changes according to the product (f×H) of the distance H to the point of action and the elastic force f.

Accordingly, even in the case where the amounts of deflection of the coil spring 65 at two or more points of action S1, S2, . . . located at different positions are not always equal, by giving the points of action different values of the product (f×H) of the distance H from the reference plane M to the point of action S and the elastic force f, different values of the pressing force F can be obtained for the points of action, respectively. Thus, the pressing force F can be changed.

It should be noted that, in the thermal print head device of this embodiment, in which the pressing force F applied to the thermal print head 62 is changed with a simple structure, the output of the thermal print head 62 may be changed according to a change in the pressing force F applied to the thermal print head 62.

Specifically, the pressing force F applied to the thermal print head 62 changes according to the position of the point of action S of the one end 65*a* of the coil spring 65 which is moved by the point-of-action switching plate 68 and to the elastic force f of the coil spring 65. The position of the point of action S of the one end 65*a* of the coil spring 65 and the elastic force f at the point of action S can be obtained in advance. Accordingly, by calculating the value of the product (f×H) which defines the pressing force F at each point of action S in advance, a determination can be made as to whether each point of action S is a position for making the pressing force F relatively large or a position for making the pressing force F relatively small.

Further, the output of the thermal print head 62 is adjusted to be larger in a state in which the point-of-action switching plate 68 is moved to, of points of action S determined as described above, a point of action S (point of action S2 in the above-described embodiment) which is a position for making the pressing force F relatively small than in a state in which the point-of-action switching plate 68 is moved to a point of action S (point of action S1 in the above-described embodiment) which is a position for making the pressing force F relatively large.

Specifically, when the pressing force F applied to the thermal print head 62 is relatively small, the frictional force between the thermal print head 62 and the thermal paper is small, and therefore the wear of the thermal print head 62 can be reduced. On the other hand, however, the contact between the heating elements of the thermal print head 62 and the thermal paper may be insufficient.

To deal with this, in the case where the pressing force F applied to the thermal print head 62 is relatively small, a shortage of contact pressure (pressing force) can be compensated for by increasing the output of the thermal print head 62 to increase thermal energy given to the thermal paper. Thus, a decline in the quality of thermal printing on the thermal paper can be prevented.

Figure 11:
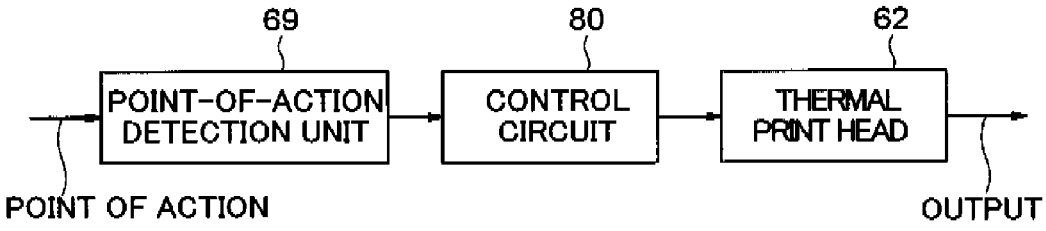
FIG. 11 is a block diagram showing a configuration in which points of action are detected to control the output of the thermal print head.

It should be noted that methods for increasing the output of the thermal print head 62 include increasing the time for which an electric current is passed through the thermal print head 62, increasing the number of pulses of the electric current passed, and the like. Such methods, i.e., increasing the current passage time, increasing the number of pulses of the electric current passed, and the like, can be carried out using an existing control circuit 80 (FIG. 11) for controlling current passage through the thermal print head 62.

Moreover, in the case where the position of the point of action S is a position for making the pressing force F relatively weak (point of action S2 in the above-described embodiment), the above-described control circuit 80 performs the above-described control for adjusting the output of the thermal print head 62. Specifically, displacement, position, or the like of the point-of-action switching plate 68 is monitored, and a point-of-action detection unit 69 (position sensor, on/off switch, or the like) is provided to detect the point of action S1 or the point of action S2 which is selected. When the point of action S detected by the point-of-action detection unit 69 is a point of action S (point of action S2 in the above-described embodiment) which corresponds to a position for making the pressing force F relatively weak, the control circuit 80 may perform control so that the output of the thermal print head 62 may be made relatively large.

It should be noted that, in addition to the above-described control, when the point of action S detected by the point-of-action detection unit 69 is a point of action S (point of action S1 in the above-described embodiment) which corresponds to a position for making the pressing force F relatively strong, the control circuit 80 may perform control so that the output of the thermal print head 62 may be made relatively small.

The thermal print head device of the above-described embodiment is configured such that the head holding plate 63 is supported by the main body 10 to be swingable toward and away from the platen roller 52, and the thermal printer 100 including this thermal print head device and the main body 10 is equivalent to an embodiment of the thermal printer according to the present invention.

The thermal print head device according to the embodiment of the present invention makes it possible to change a pressing force applied to the thermal print head with a simple structure.

Moreover, the thermal printer according to the embodiment of the present invention makes it possible to provide a thermal printer including a thermal print head device in which a pressing force applied to the thermal print head is changed with a simple structure. Although the embodiment of the present invention has been described above, the present invention is not limited thereto. It should be appreciated that variations may be made in the embodiment described by persons skilled in the art without departing from the scope of the present invention.

What is claimed is:

1. A thermal print head device comprising:

a thermal print head placed to face a platen roller;

a head holding member configured to hold the thermal print bead, the head holding member extending in a tangential direction of the platen roller and being supported to be swingable about a portion away from the platen roller;

a biasing member configured to bias the thermal print head or the head holding member, the biasing member having one end placed on a side of the thermal print head or the head holding member to press the thermal print head against the platen roller; and a point-of-action switching member disposed between the biasing member and the thermal print head or the head holding member biased by the biasing member, the point-of-action switching member moving in the tangential direction of the platen roller a point of action at which the one end of the biasing member comes into contact with the thermal print head or the head holding member.

2. The thermal print head device according to claim 1, wherein the biasing member comprises a plurality of elastic members arranged in the axial direction of the platen roller, and the point-of-action switching member extends in the axial direction of the platen roller and integrally moves respective points of action of respective biasing forces by the plurality of elastic members.

3. The thermal print head device according to claim 2, wherein the biasing member comprises an elastic-member holding member configured to hold the plurality of elastic members;

the point-of-action switching member comprises an elastic-member holding structure configured to hold end portions of the plurality of elastic members which are on a side of the thermal print head or the head holding member; and the point-of-action switching member, the elastic members held by the elastic-member holding structure, and the elastic-member holding member are integrated.

4. The thermal print head device according to claim 1, wherein the point-of-action switching member moves the point of action between a first point of action far from a supported portion serving as a center of swing of the head holding member and a second point of action near the supported portion, and the biasing force at the first point of action and the biasing force at the second point of action are set to be approximately equal.

5. The thermal print head device according to claim 1, wherein the point-of-action switching member moves the point of action by moving in the tangential direction of the platen roller in itself, comprises an operating portion configured to receive an externally inputted load to move the point of action, and the point-of-action switching member is moved in the tangential direction of the platen roller by the load inputted to the operating portion to move the point of action.

6. The thermal print head device according to claim 1, wherein output of the thermal print head is adjusted according to the position of the point of action of the one end of the biasing member which is moved by the point-of-action switching member.

7. A thermal printer comprising:

a main body; and the thermal print head device according to claim 1, wherein the head holding member is supported by the main body to be swingable toward and away from the platen roller.

* * * * *